United States Patent [19]

Reid

[11] 4,402,190

[45] Sep. 6, 1983

[54] APPARATUS AND METHOD FOR HEATING AND CHILLING CONCRETE BATCH WATER

[76] Inventor: Samuel I. Reid, P.O. Box 346, Smyrna, Tenn. 37167

[21] Appl. No.: 377,022

[22] Filed: May 11, 1982

[51] Int. Cl.[3] ..... F25D 17/00

[52] U.S. Cl. ..... 62/178; 62/238.6; 62/434; 165/18; 165/48 R

[58] Field of Search ..... 165/48 R, 18; 62/238.6, 62/430, 434, 185, 160, 178

[56] References Cited

U.S. PATENT DOCUMENTS

| | | | |
|---|---|---|---|
| 3,996,759 | 12/1976 | Meckler | 165/18 |
| 4,191,027 | 3/1980 | Inoue | 62/434 |
| 4,265,094 | 5/1981 | Haasis, Jr. | 62/238.6 |

*Primary Examiner*—Ronald C. Capossela

*Attorney, Agent, or Firm*—Pitts, Ruderman & Kesterson

[57] ABSTRACT

Modular apparatus for providing heating and cooling to large quantities of water used in a concrete batch plant prior to mixing water and concrete is disclosed. The system typically operates from a water source such as a deep well (10) which water source may serve as either a heat sink or a heat source. In addition, there is a water storage tank (34) which holds water (36) which water can be either heated or cooled as necessary for the best results in mixing concrete. There is a multiplicity (26) of modular reversable heat pumps each of which has its heat exchanger (78, 88) connected in parallel such that modular units may be added or removed without destroying the integrity of the refrigerant system. Each of the modular units includes a source heat exchanger (88) and a storage heat exchanger (78). A gaseous refrigerant compressor (70) is also provided and operates in conjunction with a reversing valve (80) such that the direction of refrigerant flow through the heating exchanger (78) and (88) may be reversed while at the same time the direction of refrigerant flow through the compressor (70) remains the same. There is further included a refrigerant expansion means (130) which also operates in combination with a fluid flow reversing bridge (104) such that the flow of fluid through the expansion valve is always in the same direction, even though the flow of refrigerant fluid through heat exchangers may be reversed. There is also included circuitry (66) which monitors and controls the operation of the reversable modular heat pumps to maintain the temperature of the storage water (36) in tank (34) at within a preselected temperature range.

9 Claims, 3 Drawing Figures

APPARATUS AND METHOD FOR HEATING AND CHILLING CONCRETE BATCH WATER

DESCRIPTION

Technical Field

This invention relates generally to heat exchangers, and more particularly to heat exchangers suitable for heating and/or chilling water used for mixing concrete. More specifically, this invention includes a modular heat pump whereby the capacity for cooling and/or heating water may be substantially increased or decreased without violating the integrity of the closed refrigerant system.

Background Art

Heat pumps are well known for their use in homes, industrial applications and the like, for heating or cooling an enclosed environment. More recently, heat pumps have been used as sources for heating water for both industrial and home uses. However, it will be appreciated that for large commercial water usage the heat pumps available heretofore have been extremely complex, costly, and difficult to maintain. Consequently, uses of such heat pumps for chilling or heating water in certain industrial applications where the failure of the system to operate would completely shut down operations, such heat pumps have not found acceptance. As an example, it is well known that concrete will fail to develope desired characteristics of strength, cure, finish and the like, unless the concrete is mixed at a temperature within a specific range usually between 50° to 90° F. Since the constituents of a concrete mix such as rock and sand are normally completely exposed to the environment, these constituents will typically be at the ambient temperature. A bigger problem exists, however, when the rock and sand constituents are exposed to direct solar rays such that their temperature may well exceed the ambient environmental temperatures. This means, that if the concrete is to be mixed within the 50° to 90° F. range other of the concrete constituents must be at temperatures sufficient to effectively raise or lower the temperature of the complete mixture to the desired temperature range. Otherwise, prior to mixing, these constituents must have their temperature adjusted. At present, it appears to be completely unreasonable to expect great quantities of rock and sand to be heated or cooled prior to mixing. Therefore, since the other main ingredients of a concrete mix are the cement and water, it becomes apparent that water may well be the constituent by which the overall temperature of the concrete mix may be controlled. Even so, of course, in extreme temperature conditions it may well be that the batch mix water must either be heated or cooled to assure that the overall concrete mix will be within the desired temperature range.

In the past, the heating of concrete batch water was typically accomplished by a boiler using fossil fuels. The cooling of the water, on the other hand, could be accomplished by simply mixing crushed ice with the mix to serve as part of the necessary water. It will be appreciated, of course, that the handling of ice and water complicated the process and often resulted in less than a desirable mixture of concrete. To those skilled in the art, it will be appreciated that many simple applications of concrete, such as the home driveway and home retaining walls, could be accomplished by concrete which had less than the most desirable characteristics.

However, for applications such as dams, high rise buildings, and other very complex structures, it is essential that the concrete achieve its maximum strength and performance.

As was mentioned heretofore, it is possible to use conventional large refrigeration units to cool the water for a concrete batch plant. However, as will be appreciated by those skilled in the art, such refrigeration units are sensitive and difficult to maintain. At the same time, the environmental conditions of a concrete batch plant are less than desirable. That is, the environment is usually extremely dusty and often subject to abuse encountered by large trucks and equipment.

Therefore, it will be appreciated that if the refrigeration plant had to be shut down, then, the concrete batch plant would in turn have to be shut down which might result in the further shut down of a multi-million dollar dam or other structure. Such a shut down, of course, may have drastic financial effects.

Therefore, it is an object of this invention to provide apparatus for heating and chilling batch water which is not subject to maintenance shut down.

It is another object of this invention to provide apparatus which combines the functioning of heating and chilling concrete batch water into a single system.

It is still another object of the present invention to provide apparatus for chilling and heating concrete batch water which is inexpensive to operate and which can readily have its capacity expanded or decreased.

It is still another object of this invention to provide apparatus for chilling and cooling concrete batch water which can continue to operate in the event of a partial equipment failure.

DISCLOSURE OF THE INVENTION

Other objects and advantages will in part be obvious and will in part appear hereinafter, and will be accomplished by the present invention which provides apparatus for the temperature conditioning of water. The apparatus comprises a water source which operates both as a heat sink and a heat source and provides the water used in a concrete batch plant. The water used in mixing the concrete is stored in a storage tank which maintains the water at a selected temperature. To achieve the selected temperature, a multiplicity of reversable heat pumps are connected to each other in parallel. Each of these multiplicity of heat pumps include a refrigerant which is suitable for operating between a liquid phase and a gas phase. A source water heat exchanger receives and discharges water from the water source, and acts as a heat sink/source for exchanging heat between the refrigerant medium passing therethrough and the source water. The heat exchanger includes a gas and liquid port wherein the refrigerant may enter as one phase and exit as the opposite phase. In a similar manner, there is a storage heat exchanger which has water from the storage tank circulating therethrough. In a manner similar to the source water heat exchanger, the refrigerant also passes through this heat exchanger which includes both a gas port and a liquid port to accommodate a phase change. A compressor connected in the system collects the gaseous refrigerant at a low pressure and returns it to the system at a much higher pressure. Also connected in the gas phase portion of the heat pump is a reversing valve which operates to always maintain the gas flow through the compressor in the same direction (i.e. from the low pressure to the high pressure side) while at the same time allowing the direction of the gas refrigerant flow through the two heat exchangers to be reversed. Also included is a refrigerant expansion means which has a high pressure port and a low pressure port, and which has the liquid refrigerant passing therethrough. A fluid flow reversing bridge comprised of four one-way valves is connected between the liquid refrigerant port of the source heat exchanger and the liquid refrigerant port of the storage heat exchanger. The reversing bridge operates to maintain the liquid flow direction through the expansion means from the high pressure port to the low pressure port. This means the direction of the liquid refrigerant flows through the heat exchangers in response to the direction of the gas refrigerant flow which was determined by the above-discussed reversing valve and compressor. Finally, there is also included circuitry for maintaining and controlling the operation of the reversable heat pumps to maintain the temperature of the storage water within a preselected temperature range.

BRIEF DESCRIPTION OF THE DRAWINGS

The above-mentioned features of the present invention will be more clearly understood from the consideration of the following descriptions in connection with the accompanying drawings in which.

BEST MODE FOR CARRYING OUT THE INVENTION

Figure 1:
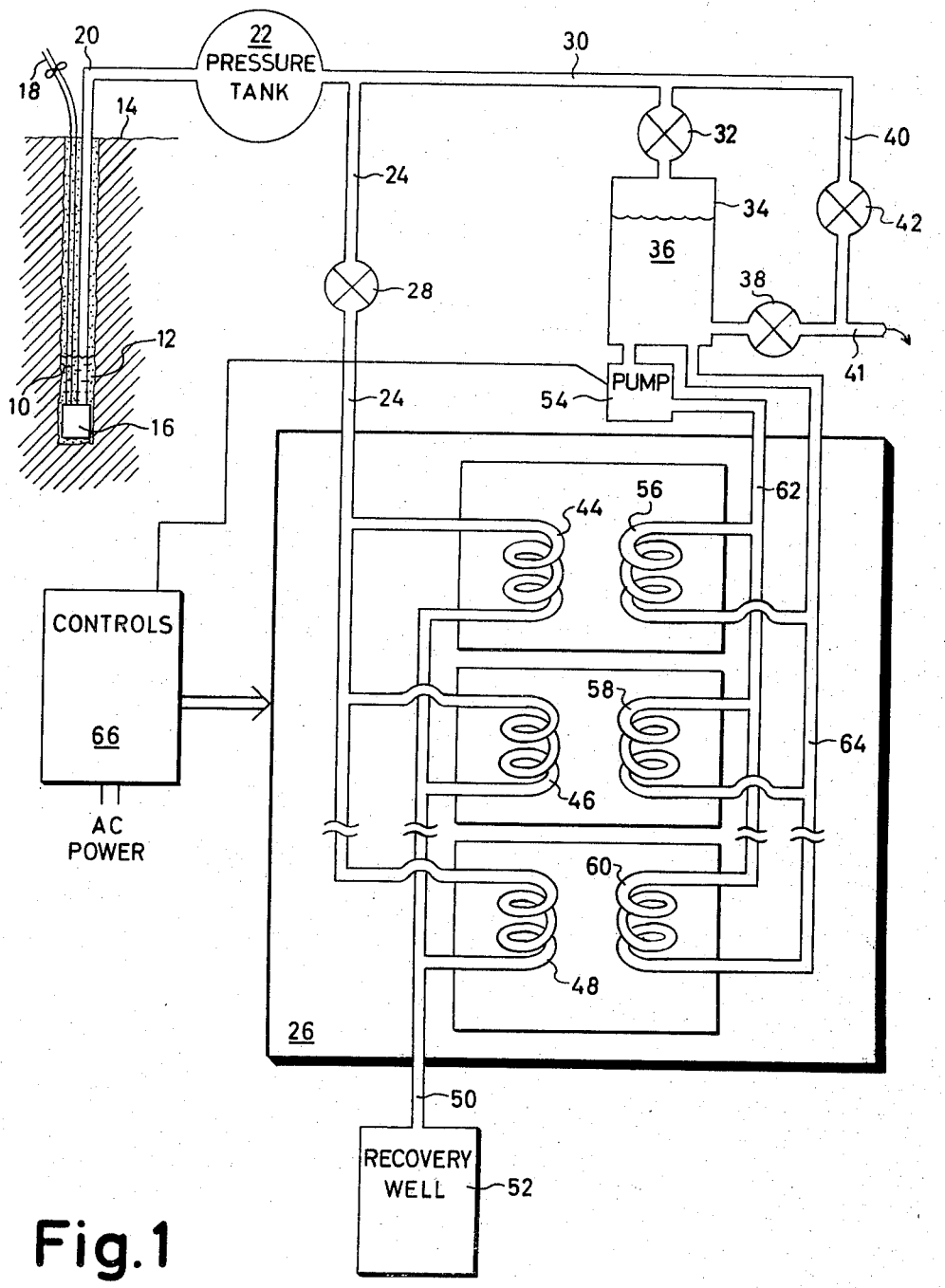
FIG. 1 is a partial block diagram of water temperature control apparatus showing the multiplicity of heat pumps and other features of this invention.

Referring now to FIG. 1, there is shown the water temperature control apparatus of this invention. As shown according to a preferred embodiment there is a deep water well 10 which includes a source of water 12. This water 12 is pumped to the surface of the earth 14 by means of a submerisable pump 16. Pump 16 typically receives AC power from power lines 18. Water 12 is provided to the surface 14 of the earth by means of conduit 20, and is then typically stored in a series of one or more pressure tanks 22 where the water is kept at a desired pressure. The water in pressure tanks 22 may then be provided to water line 24 where it serves as a heat source or heat sink for the multiplicity 26 of modular heat pumps to be discussed hereinafter. Although, not essential to the operation of this invention, there is shown a hand valve 28 for allowing the water to the modular heat pumps 26 to be cut off. In addition, in the preferred embodiment, the water from pressure tank 22 is also provided by line 30 through another hand valve 32 to a water storage tank 34 such that water in storage tank 34 is maintained at a selected level. It is the water in water storage tank 34, as will be discussed hereinafter, which is circulated through the modular heat pumps 26 such that the temperature of water 36 may be maintained within a desired temperature range. Water 36 then exits water tank 34 through an adjustable valve 38 and is provided to a truck or other apparatus as the water used in mixing the concrete. Since the water 36 in water tank 34 is maintained at a constant temperature, it will typically be either hotter than desired or colder than desired depending upon whether it is winter or summer. Therefore, source water from water conduit 30 is provided to conduit 40 which is also connected through valve 42 to outlet conduit 41 such that the water 36 in tank 34 may be mixed with the water in conduit 40 to achieve a particular temperature of the delivered water.

Referring again to the multiplicity 26 of modular water heat pumps, it can be seen that input line 24 is connected to heat exchangers 44, 46, and 48. In a similar manner, the output of these heat exchangers is connected to a single dump line 50. Thus, it can also be seen that these heat exchangers 44, 46 and 48 are all connected in parallel such that water flowing through line 24 will flow into the individual heat exchangers and out to dump line 50 such that the water which has served as either a heat source or heat sink can be directed towards a recovery well 52 or simply dumped. In a similar manner, it can be seen that water 36 is pumped from tank 34 by means of pump 54 to the modular storage heat exchangers 56, 58 and 60. As was the case with respect to the source heat exchangers 44, 46, and 48, each side of one of the heat exchangers 56, 58 and 60 is connected to line 62 which receives storage water 36 from the output of pump 54. The other end of heat exchangers 56, 58 and 60 is connected to line 64 such that the water 36 is returned to the tank 34.

Finally, in addition to the multiplicity 36 of heat exchangers, there is also shown control circuitry 66 which is used to both monitor and control the operation of the system. As shown, control 66 not only controls the modular water heaters, but also can be used to control circulating pump 64.

Figure 2:
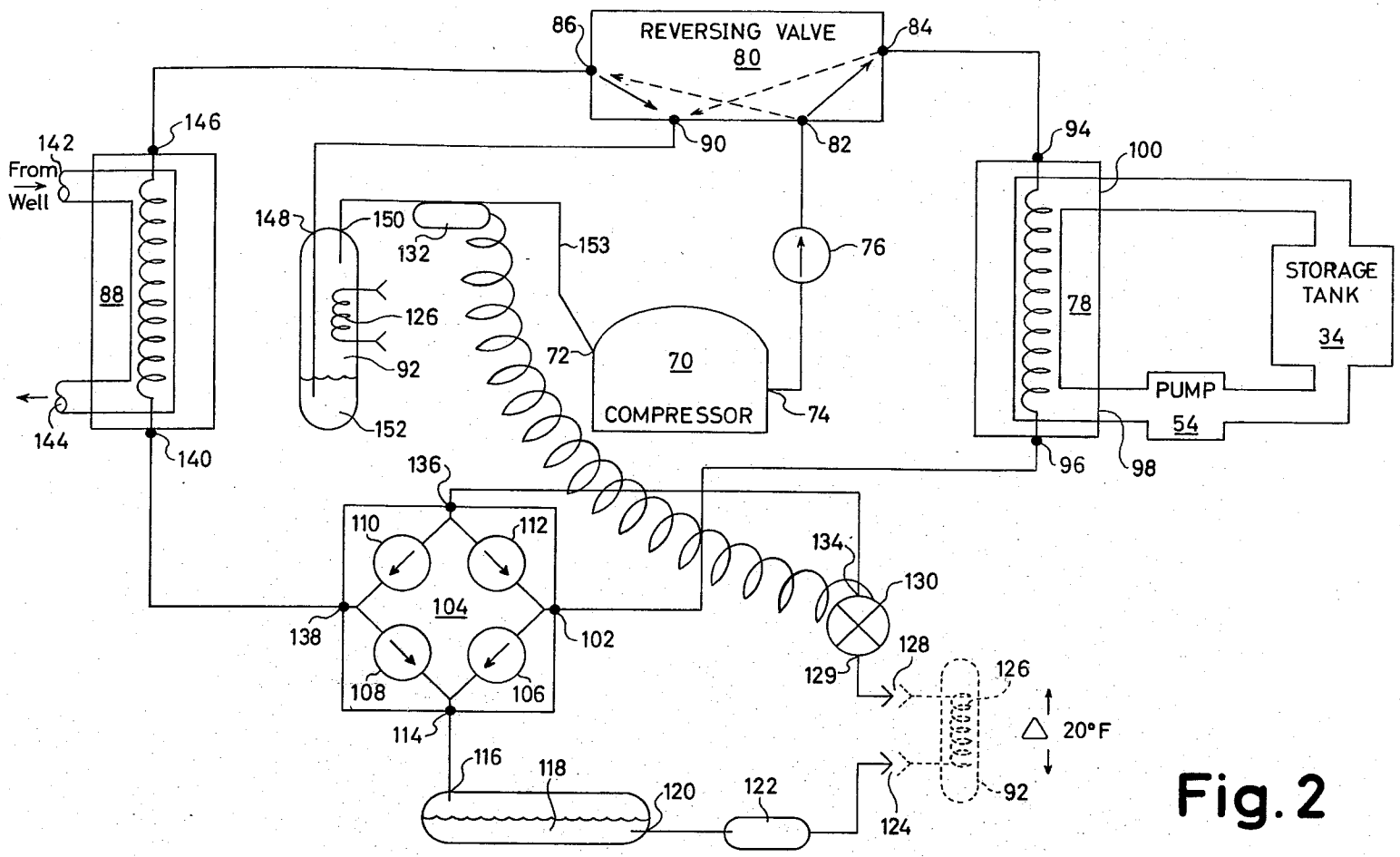
FIG. 2 is a fluid schematic diagram of one of the multiplicity of reversable heat pumps which include features of the present invention.

Referring now to FIG. 2, there is shown a fluid schematic of one of the multiplicity 26 modular heat pumps. As was discussed heretofore, it will be appreciated that each of these heat pumps is completely isolated except for its source water and its storage water connections. Thus, any number of these systems can be added or removed from the overall system without violating the integrity of the refrigerant system. This feature simplifies maintenance, and eliminates the requirement of high skilled refrigerant maintenance personnel.

Also, of course, it will only be necessary to describe the operation of a single one of these modular heat pumps since all of the heat pumps operate in a similar manner.

As shown, the fluid schematic includes a compressor 70 which has a low pressure port 72 and a high pressure port 74. As will be appreciated by those skilled in the art, gas refrigerant is typically received by a compressor at a low pressure and then provided at a high pressure which typically may be at 250 PSI and at 190° F. This high pressure, high temperature gaseous refrigerant is then provided through a discharge check valve 76 which, as will be discussed hereinafter, is used to prevent liquid refrigerant from storage heat exchanger 78 (to be discussed hereinafter) returning to compressor 70. It will be appreciated by those skilled in the art, that it is necessary to prevent any liquid refrigerant from being returned to the top of the compressor if catastropic failure is to be avoided.

The high pressure gaseous refrigerant is then provided to a reversing solonoid valve 80 at port 82. Reversing solonoid 80 further includes a port 84 connected to the storage heat exchanger 78. In addition, reversing solonoid valve 80 includes port 86 connected to the gaseous port of source heat exchanger 88, which heat exchanger also will be discussed in detail later. Finally, reversing solonoid valve 80 includes port 90 which is connected to accummulator 92. According to the present embodiment, the unactivated state of reversing solonoid valve 80 is used when the heat pump is operating in the cooling mode. When this nonactivated state of reversing valve 80 is used, internal fluid connecting paths are arranged such that port 82 is connected to port 86 and port 84 is connected to port 90. On the other hand, when the system is operating in the heating mode operating valve 80 is in an activated state and port 82 is connected to port 84 and port 86 is connected to port 90.

In the embodiment shown in FIG. 2, the reversing valve 80 is shown activated such that the solid lines represent a fluid communication path from port 82 to port 84, and from port 86 to port 90. The dashed lines in reversing valve 80 represent the fluid flow paths when the valve is in the nonactivated state, and shows connections between ports 84 and 90, and ports 82 and 86. Thus, it can be seen that the output of compressor 70 is through check valve 76, and is then routed from port 82 to port 84 of reversing valve 80. Thus, port 84 of reversing valve 80 is in turn connected to the gaseous port 94 of the storage heat exchanger 78. Storage heat exchanger 78 also includes a liquid phase port 96, such that the refrigerant which enters the heat exchanger as a gas may substantially change phases and become a liquid. Also included as part of heat exchanger 78 are the ports 98 and 100 which as can be seen are connected to storage tank 34. Circulating pump 54 as was discussed heretofore continuously circulates water 36 from the storage tank 34 through the heat exchanger 78 such that the refrigerant passing from port 94 to port 96 of heat exchanger 78 is able to condition the temperature or adjust the temperature of the circulating water even though the refrigerant and water are maintained physically separate. As was indicated heretofore, port 96 of storage heat exchanger 78 only represents the liquid port of the heat exchanger. In the heating mode, the liquid refrigerant which has now changed phase from a gas will be directed from port 96 to junction 102 of fluid flow reversing bridge 104. In a preferred embodiment, fluid flow reversing bridge 104 is comprised of four one-way check valves 106, 108, 110 and 112. It can be seen that since the liquid fluid flow of refrigerant is into port 102, one-way check valve 112 will prevent the flow of fluid in that direction. However, valve 106 readily permits the continuous flow of fluid therethrough, and onto port 114 of fluid flow reversing bridge 104. It can further be seen that the fluid flow at 114 cannot continue past valve 108 and therefore must exit at port 114 where it continues on to the inlet port 116 of charge compensator 118.

Although not always required in refrigeration or heat pump usage, it will be appreciated by those skilled in the art that because of the extreme operating temperatures required by the heat pump of this invention, there can be an overall volume expansion of the refrigerant on the order of 33%. That is, this heat pump unit will be required to operate in a heating mode by receiving source water at between 35° and 115° F. while providing hot water at the output of storage heat exchanger 78 on the order of 140° F. In the cooling mode, on the other hand, the source water input will be substantially the same; whereas, the storage water will be cooled to perhaps 35° F. by means of storage heat exchanger 78. Thus, although the source water will remain almost constant, the storage heat exchanger will work at about 35° F. in the cooling mode and 160° F. in the heating mode. It is this substantial temperature difference in the operating temperature of the refrigerant which results in the substantial volume change.

The liquid which has flown into charge compensator 118 will then exit through port 120 on through a filter 122 and then into port 124 of a secondary heat exchanger 126. As will be discussed hereinafter, heat exchanger 126 cooperates with the accummulator 92 discussed above. As the liquid refrigerant passes from port 124 of heat exchanger 126 to the output port 128, there will typically be about a 20° F. temperature differential. That is, the temperature will be 20° F. less at port 128 than it was at port 124. The output port 128 of heat exchanger 126 then provides the liquid refrigerant to expansion valve 130. As will be appreciated by those skilled in the art, expansion valve 130 provides a pressure drop and the expansion of the refrigerant. In the embodiment shown, expansion valve 130 includes an orfice therethrough which is adjustable by means of a needle valve responsive to thermal bulb 132. The thermal bulb 132 and needle valve 130 cooperate such that as the thermal bulb senses increased heat, the needle of the expansion valve 130 will open to increase the size of the orfice therethrough. As shown, the high pressure or input port of expansion valve 130 is indicated by reference number 129 and the low pressure or output port is indicated by reference number 134. Thus, the output port 134 of expansion means 130 then directs the fluid flow to port 136 of the fluid flow reversing bridge 104. It will be noticed, that as the fluid flows into port 136, both check valves 112 and 110 could normally allow fluid flow therethrough. However, it will be recalled that the liquid refrigerant from the heat exchanger 78 had not yet passed through expansion means 130 and was at a higher pressure. This higher pressure liquid refrigerant is on the opposite side of check valve 112, and therefore, it will be appreciated that there is a greater pressure on check valve 112 from port 102 then there is on the valve from port 136. Consequently, the fluid flow will be restricted to pass through check valve 110 onto port 138 of fluid flow reversing bridge 104. In a similar manner, although the fluid could normally continue through check valve 108, there is a higher pressure already existing on check valve 108 due to the presence of high pressure refrigerant fluid which left the bridge 104 through port 114. Consequently, the flow of liquid refrigerant is out port 138, and on to the liquid port 140 of heat exchanger 88. Heat exchanger 88 permits a flow of continuous temperature water into port 142 which passes refrigerant coils of the heat exchanger. In a preferred embodiment, it will be appreciated that the water entering at port 142 is typically from a deep well and has a constant temperature. Once the water has either received heat or supplied heat, the water may be exhausted from port 144 to a recovery well or simply dumped. As will also be appreciated by those skilled in the art, the temperature of water from a deep well is substantially maintained at a constant temperature throughout the year. In a particular well, the temperature was found to remain steady at 59.8° F. both winter and summer. However, it will also be appreciated that in other areas the temperature of the water may be somewhat less or even higher. Thus, in the heating mode described to this point, the liquid refrigerant entering heat exchanger 88 through port 140 will absorb heat from the well water passing from port 142 to port 144 of the heat exchanger 88, such that the refrigerant will exit heat exchanger 88 as a gas at port 146. The gas refrigerant is then passed from exit port 146 to port 86 of the reversing solonoid valve 80 discussed heretofore.

Further, as was discussed heretofore, in the heating mode, the fluid communication paths within the reversing solonoid valve 80 is such that the gaseous refrigerant is passed through port 86 to port 90. The gaseous refrigerant then proceeds from port 90 of the reversing solonoid valve 80 to inlet port 148 of the accumulator 92. As will be appreciated by those skilled in the art, the accummulator 92 is typically provided to assure that a slug of liquid refrigerant (which might have made its way through the heat exchanger or which might have in some other way changed from a gas stage to a liquid phase) is not allowed to continue on to the intake port 72 of compressor 70 which would cause catastrophic failure. Thus, the outlet port 150 is located such that any collection of liquid refrigerant such as shown at 152 cannot make its way to the outlet port 150 and then on to compressor 70.

The gaseous refrigerant is then provided to conduit 153 from outlet port 150 of the accummulator to inlet port 72 of compressor 70. At that point, it will be appreciated that the cycle just discussed can then be repeated. It is also well to note, that thermal bulb 132 according to this embodiment monitors the temperature of the refrigerant gas conduit 153 for purposes of changing the position of the needle of expansion valve 130 and thereby adjusting the size of the orfice. Therefore, it can be seen that this system operates as a closed loop servo system in that the more the expansion valve 130 is opened, the lower the temperature of the refrigerant passing from the heat exchanger into the accummulator 92. This means that the temperature of thermal bulb 132 is lowered which in turn will tend to close the orfice of the expansion valve 130. As the expansion valve orfice closes, of course, the volume of refrigerant will be reduced thereby resulting in a warmer gas refrigerant though conduit 153 which tends to open the needle valve. In this manner, it will be appreciated that the system can be adjusted to always operate at maximum efficiency.

Therefore, it will be appreciated that the above discussion has shown how water 36 in storage tank 34 may be heated by the present apparatus. However, it will be appreciated that although such heated water is necessary and desirable in concrete batch mixtures in the winter time, in the summer time the water should be chilled rather than heated. To operate in the cooling mode, it will be appreciated that reversing solonoid valve 80 must be changed such that port 84 is connected to port 90 and port 82 is connected to port 86. In such a change, the flow of refrigerants through the accumulator 92, compressor 70, check valve 76, receiver 118, liquid line filter 192, heat exchanger 126, and expansion valve 130 will be in exactly the same direction as discussed heretofore. However, because of the change in the reversing solonoid valve 80, and the operation of the fluid flow reversing bridge 104, the flow of refrigerants through heat exchangers 78 and 88 will be reversed. That is, heat will be removed from the water circulating from storage tank 34 and collected by the deep well water flowing through heat exchanger 88. In either event, however, it will be appreciated that although the direction of fluid flow through heat exchangers 77 and 78 is reversed, ports 94 and 146 still remain the gaseous ports of these heat exchangers respectively; whereas, ports 96 and 140 remain the liquid ports.

According to the cooling mode, therefore, it will be appreciated that the high pressure high temperature gaseous output of compressor 70 will be provided to port 82 of reversing valve 80 where it is then directed to port 86 and on to the gas port 146 of heat exchanger 88. As the gaseous refrigerant enters heat exchanger 88 it will give up heat to the flow of deep well water and consequently it will exit port 140 of heat exchanger 88 as a liquid. The liquid refrigerant then flows to port 138 of the fluid flow reversing bridge 104 where it is prevented from going through valve 110, and therefore passes on through valve 108 to port 114. At port 114 it can be seen that the fluid cannot flow through check valve 106 and thus must continue its flow to charge compensator 118 in the same manner as was discussed above with respect to the heating cycle. The liquid fluid flow continues through the charge compensator 118, the filter 122, the heat exchanger 126, and the expansion means 130 as was discussed above with respect to the heating mode where it then again enters fluid flow reversing bridge 104 at port 136. The refrigerant at this point could normally go through either valve 110 or 112, except that it will be recalled that there is a high pressure liquid on the opposite side of check valve 110. Therefore, this high pressure liquid will then hold that check valve closed such that the only possible direction for the fluid flow is through check valve 112 on to port 102. Although the liquid could seemingly go through valve 106, high pressure liquid is also holding that valve closed such that the only option for the flow is out of port 102 and on to the liquid port 96 of the storage heat exchanger 78. As the liquid refrigerant passes through the storage exchanger 78, it will absorb heat from the water circulating from storage tank 34 and exit heat exchanger 78 at port 94 as a gas. The gaseous refrigerant then continues on to port 84 of reversing valve 80 which conducts the gaseous refrigerant to port 90 and on to the accummulator 92. Accummulator 92 operates in exactly the same manner as discussed above and allows the gas refrigerant to move on to inlet port 72 of compressor 70 thereby completing the cycle.

Thus, it will be appreciated that there has been discussed to this point operation of one of the multiplicity of modular heat pumps of this invention which can provide either heat or cooling to circulating water 36 in a storage tank 34.

As will be appreciated by those skilled in the art, refrigerant in a heat pump or a refrigerator device always tends to migrate such that it can be in a cooler state when the compressor is turned off. Thus, it will be appreciated that when the present system is operating any refrigerant which might change to a liquid phase will be caught by the accummulator 92 thereby preventing the possibility of a slug of liquid refrigerant finding its way to at compressor 70.

An important aspect of this invention is that by the use of the modular construction and packaging, it is possible for a single maintenance person to simply replace a module without having to shut down the system or without having to violate the integrity of the refrigerant system. Also, there is often the problem of compressor motor overlead on starting due to unequal pressure in the system. To prevent this problem in a 3 phase electrical systems, according to the present invention, at the end of each cooling cycle and after the compressor has completely shut down, the reversing valve 80 is actuated and moved to the heating mode position for a selected period of time such as, for example, 30 seconds to allow equalization of the refrigerant pressure throughout the system.

Figure 3:
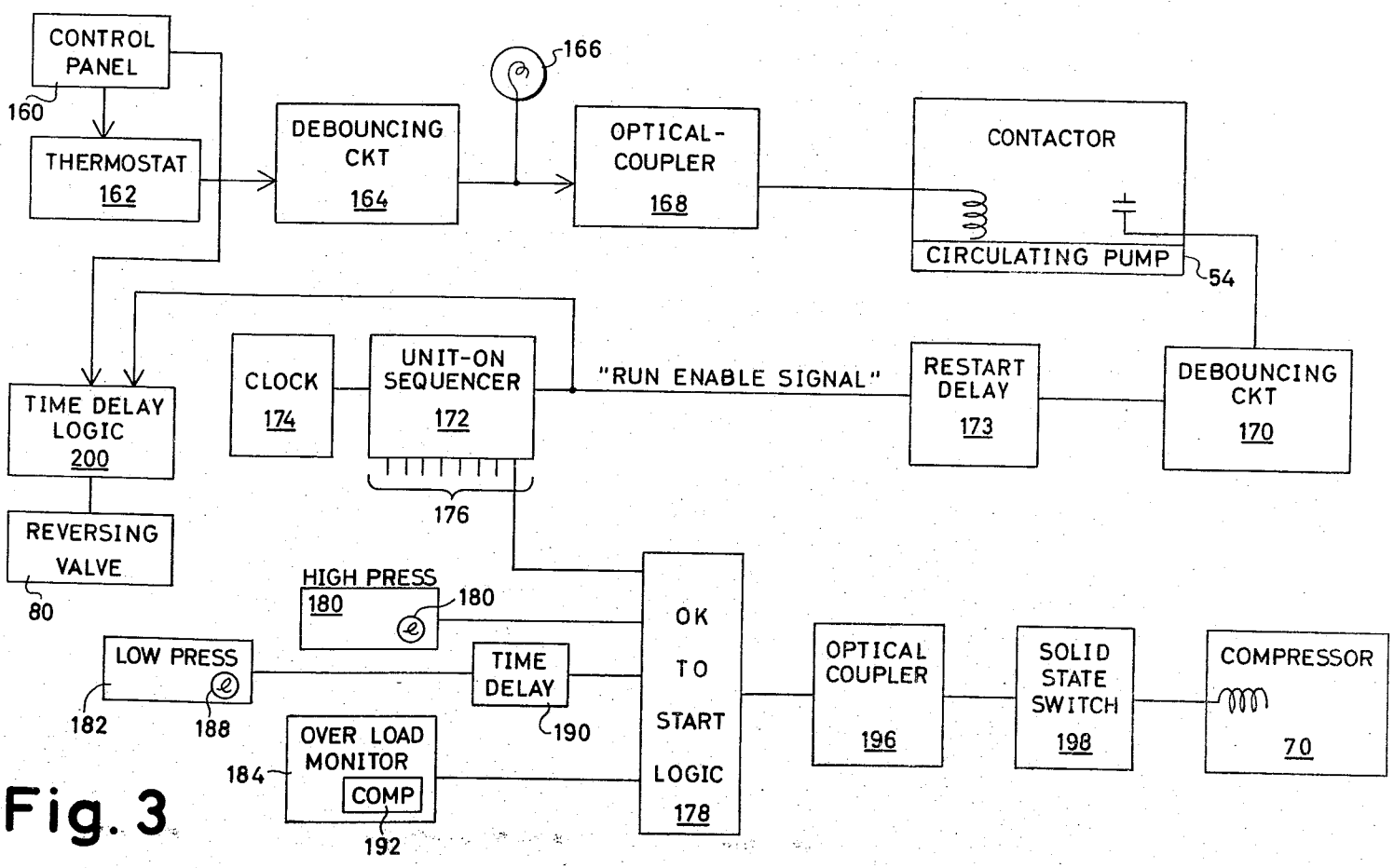
FIG. 3 is an electrical block diagram showing the necessary elements for controlling the water control apparatus of this invention.

Referring now to FIG. 3, there is shown an electrical schematic for controlling the apparatus of this invention. As shown, at control panel 160 a manual selection is made with respect to whether the system shall operate in the heating or cooling mode. The manual selection also assures the proper positioning of the reversing valve 80 as discussed heretofore with respect to FIG. 2. In addition, the selection of heating or cooling by control panel 160 also determines the temperature at which the thermostat 162 will operate. Thus, once thermostat 162 has determined the water 36 contained in storage tank 34 needs to be heated or cooled depending upon the selected mode, the thermostat will initiated energization of the system. The signal from the thermostat 162 in the present invention is passed through signal debouncing circuitry 164 to prevent chattering of the system. The output of debouncing circuit 164 will provide a signal to indicator light 166 to inform the operator that the system is in a demand condition. In addition, the output of the bouncer circuit 164 is provided to an optical coupler 168 which in the present invention is used to isolate the 24v control system from the typical 5v transistor logic portions. Thus, once the optical coupler 168 is energized, it will provide a control signal to the circulating pump 54 to close its contactors and start the pump running. Circulating pump 54 in a preferred embodiment, includes monitoring circuitry which operates therewith such that when the three phase power contactors of the circulating pump 54 are closed, a signal is provided to a second debouncer circuit 170 which in turn provides a "run enable signal" to the unit-on sequencer 172. In a preferred embodiment, however, rather than the run enable signal being passed directly from the debouncer circuit 170 to the unit-on 172, there is also included a restart delay circuitry 173. This restart delay circuitry prevents the restarting of the system for a selected time delay such as for example two minutes after shut down of the system for any cause whatsoever. In addition to the run enable signal being provided to the unit-on sequencer 172, the run enable signal is also provided to a time delay circuit 174 to be discussed hereinafter. In addition to receiving the run enable signal, unit-on sequencer 172 also receives a clocking pulse signal from clock 174 which in a particular embodiment provides pules at two second intervals. The unit-on sequencer 172 therefore will provide an output on the multiplicity of lines 176 at two second intervals. Each of the output lines 176 are used to control one each of the individual modules of the heat pump of this invention.

Thus, it will be appreciated that for purposes of this discussion it is only necessary to discuss the circuitry which controls one of the modules. As shown, one of the multiplicity of lines 176 is provided to OK to start logic 178 of a selected module. In addition to the input on line 176 to "OK to start logic" module 178 there is also a high pressure monitor 180, a low pressure monitor 182 and a compressor overload monitor 184 which are continuously scanned. As shown, the high pressure monitor 180 also includes a light indicator 186 which indicates the precise module which has a high pressure condition. Likewise, the low pressure monitor includes an indicator light 188 for indicating a low pressure condition. It will also be noted, that between the low pressure monitor 188 and the OK to start logic module 177 there is a time delay module 190 which in most embodiments will be approximately 30 seconds. The purposes of this time delay is to assure that a premature low pressure shut down does not occur on start-ups. To assure that the compressor itself is not overloaded, the present invention includes comparator circuitry 192 to determine the load being carried by the compressor. The load is continously compared to a reference value such that if the load ever matches the reference value, an overload signal will be provided to the OK to start logic 178. Thus, it will be appreciated that the OK to start logic 178 receives inputs from the high pressure sensor, the low pressure sensor, the compressor overload sensors and the unit on sequencer. So long as the logic determines that the system is not in a high pressure mode, low pressure mode, or overload, and so long as the OK to start signal is present from the unit on sequencer 172, the start signal is provided on line 194 to an optical coupler 196 which is used to provide circuit isolation. The output of optical coupler 196 will activate a switch 198 which in the preferred embodiment is a Solid State switch such as a triac. The Solid State switch will in turn energize the compressor contactors 70 thereby starting the heat pump cycle.

As was indicated heretofore, manual control 160 provides an output to time delay logic 200 to indicate whether the system is to operate in the heat or cooling mode. In addition, time delay logic 200 also receives the run enable signal previously provided to the unit-on sequencer 172. In heating operations, time delay logic 200 simply passes the run enable signal on such that the reversing valve 80 is actuated in order that the system may operate in the heating mode. However, in the cooling mode, there is of course no signal provided to reversing valve 80 during the operation of this mode. However, upon the termination of the run enable signal which occurs when the system shuts down and with the presence of the cooling mode signal from manual control panel 160 indicating the system is in a cooling mode, reversing valve 80 (as was discussed heretofore) will be activated for a period of time of about 30 seconds as determined by time delay logic 200. As further discussed heretofore, this 30 second activation of reversing valve 80 will allow equalization of the refrigerant in the system to prevent compression overload.

While there have been described what are at present considered to be preferred embodiments of this invention, it will be obvious to those skilled in the art that various changes and modifications may be made therein without departing from the invention, and it is, therefore, intended to cover all such changes and modifications as fall within the true spirit and scope of the invention.

I claim:

1. Water temperature control apparatus for providing temperature conditioned water comprising:

a water source for selectively operating as a heat sink and a heat source;

a water storage tank for holding temperature conditioned water;

a multiplicity of reversable heat pumps each having all external water source ports connected to each other in parallel, said multiplicity of heat pumps for selectively controlling the temperature of water in said storage tank, each of said multiplicity of reversable heat pumps comprising;

a refrigerant suitable for changing phase between a liquid and a gas phase in response to pressure and temperature, a source water heat exchanger for receiving and discharging water from said water source and for passing said refrigerant therethrough, said source water exchanger including a gas refrigerant port and a liquid refrigerant port, and said water and said refrigerant cooperating to exchange heat therebetween while being maintained physically separate from each other, a storage water heat exchanger for receiving and discharging water circulating between said water storage tank and said heat exchanger and for passing said refrigerant therethrough, said storage heat exchanger including a gas refrigerant port and a liquid refrigerant port, and said storage water and said refrigerant cooperating to exhange heat therebetween while being maintained physically separate from each other, a refrigerant compressor having a low pressure port and a high pressure port for compressing refrigerant in a gaseous form, a reversing valve connected between said gas refrigerant port of said source heat exchanger, and said gas refrigerant port of said storage heat exchanger, and between said compressor low pressure port and said compressor high pressure port, said reversing valve operating to maintain gas flow through said compressor from said low pressure port to said high pressure port while selectively changing the direction of gas refrigerant flow through said source and said storage heat exchangers, a refrigerant expansion means having a high pressure port and a low pressure port for passing liquid refrigerant therethrough, a fluid flow reversing bridge comprising four fluid one-way valves connected between said liquid refrigerant port of said source heat exchanger, and said liquid refrigerant port of said storage heat exchanger, and between said high pressure port and low pressure port of said expansion means, said reversing bridge operating to maintain liquid flow through said expansion means from said high pressure port to said low pressure port while selectively changing the direction of liquid refrigerant flow through said source heat exchanger and said storage heat exchanger in response to the direction of gas refrigerant flow as determined by said reversing valve; and circuitry for monitoring and controlling the operation of said multiplicity of reversable heat pumps to maintain the temperature of said storage water within a preselected temperature range.

2. The control apparatus of claim 1 and further including an accummulator connected between said reversing valve and said low pressure port of said refrigerant compressor for assuring that no refrigerant in a liquid phase is provided to said compressor.

3. The control apparatus of claim 2 wherein said expansion means is an adjustable needle expansion valve and further includes temperature sensing means for monitoring the temperature of gaseous refrigerant flowing between said accummulator and said compressor and for automatically adjusting said needle expansion valve in response to changes in temperature of said gaseous refrigerants.

4. The control apparatus of claim 2 and further including a charge compensator connected between said fluid flow reversing bridge and said high pressure port of said expansion means for allowing variations of refrigerant volume due to changes in temperature.

5. The control apparatus of claim 4 and further including a heat exchanger connected between said charge compensator and said expansion valve, said heat exchanger cooperating with said accummulator for providing heat from refrigerant in said liquid phase to refrigerant in said gaseous phase.

6. The control apparatus of claims 1, 2, 3, 4 or 5 wherein said circuitry includes means for actuating said reversing valve at the termination of operation after said system has cooled said storage water to equalize refrigerant pressure throughout said apparatus for minimizing compressor motor starting loads.

7. The control apparatus of claim 6 wherein said multiplicity of heat pumps are controlled by said circuitry such that they are energized in sequence with a selected time delay between the energization of each heat pump.

8. The control apparatus of claims 1, 2, 3, 4 or 5 and further including a circulating pump for circulating water between said storage tank and said storage heat exchanger and wherein said circuitry includes means for assuring said circulating pump is operating before energizing said multiplicity of heat pumps.

9. The control apparatus of claims 1, 2, 3, 4, or 5 wherein said water temperature control apparatus is for controlling the batch water temperature in a concrete plant.

* * * * *